US005543595A

United States Patent [19]

Mader et al.

[11] Patent Number: 5,543,595

[45] Date of Patent: Aug. 6, 1996

[54] CIRCUIT BREAKER WITH A BLOCKING MECHANISM AND A BLOCKING MECHANISM FOR A CIRCUIT BREAKER

[75] Inventors: Hans-Jürgen Mader, Koblenz; Rainer Arenz, Alfter, both of Germany

[73] Assignee: Klöckner-Moeller GmbH, Bonn, Germany

[21] Appl. No.: 381,774

[22] Filed: Feb. 1, 1995

[30] Foreign Application Priority Data

Feb. 2, 1994 [DE] Germany ..... 9401785 U

[51] Int. Cl.[6] ..... H01H 23/00

[52] U.S. Cl. ..... 200/401; 200/DIG. 42

[58] Field of Search ..... 200/400, 401, 200/DIG. 42; 335/9, 15, 16, 18, 21

[56] References Cited

U.S. PATENT DOCUMENTS 4,165,453 8/1979 Hennemann .
4,546,224 10/1985 Mostosi ..... 200/401
5,184,717 2/1993 Chou et al. ..... 200/401
5,296,664 3/1994 Crookston et al. .
5,304,765 4/1994 Parks et al. ..... 200/401

FOREIGN PATENT DOCUMENTS 8023509 11/1980 Germany .
3033213 3/1982 Germany .

*Primary Examiner*—David J. Walczak
*Attorney, Agent, or Firm*—Nils H. Ljungman and Associates

[57] ABSTRACT

A circuit breaker with a blocking mechanism having reversing levers which are rotatably mounted on both sides of the supporting lever of the circuit breaker, which reversing levers are in contact with the upper toggle in an interlocking manner. The reversing levers are moved when the switch latch moves. If there is an attempt to switch "off" when the contacts are welded together, the further movement of the switch latch is prevented by stops on the selector shaft. When switching "off" is performed when the contacts are satisfactorily open, the reversing levers automatically reverse the toggle system with regard to overcoming the throw-over point thereof, so that the "off" position of the circuit breaker is reached reliably.

5 Claims, 14 Drawing Sheets

CIRCUIT BREAKER WITH A BLOCKING MECHANISM AND A BLOCKING MECHANISM FOR A CIRCUIT BREAKER

BACKGROUND OF THE INVENTION

1. Field of the Invention

The present invention generally relates to a circuit breaker with a switch latch moveable by means of a manual operating handle for the purpose of switching the breaker on and off, and a supporting lever which is moved along therewith. One end of the lever is pivotable about a fixed axle, and the other end of the lever co-operates with a latch. The circuit breaker also includes a toggle system with an upper and a lower toggle connected together in an articulated manner by means of a toggle axle. The upper toggle can be coupled to the supporting lever, and the lower toggle can be coupled to a contact carrier. The contact carrier can be provided with moveable contact members and can be connected to a selector shaft. An actuating spring can be arranged between the switch latch and toggle axle and can act upon the toggle system, and a reversing lever prevents the transfer of the manual operating handle into the switched "off" position when the moveable contact members are blocked in the "on" position due to welding.

2. Background Information

Circuit breakers with a blocking lever countering the transfer of the manual operating handle into the switched "off" position when the moveable switch mechanism is blocked in the "on" position are disclosed, for example, in German Utility Model No. 80 23 509, German Patent No. 30 33 213, and U.S. Pat. No. 4,165,453.

In accordance with safety requirements, when contacts are welded, the operating handle of a switch or circuit breaker essentially must not be able to be put into the "off" position in order to avoid locking of the switch with welded contacts.

OBJECT OF THE INVENTION

The object of the present invention is to modify a circuit breaker of the type described above in such a way that the switch latch no longer reaches the "off" position when the contacts are welded together. Additionally, it should also be possible that the same arrangement, during normal switching "off", i.e. when the contacts are not welded together, also permits the operating handle and the switch latch to always be able to reach the "off" position.

SUMMARY OF THE INVENTION

This object can preferably be solved by the circuit breaker in accordance with the present invention, in that on both sides of the supporting lever, a reversing lever can be rotatably mounted and a part thereof can be in contact, in an interlocking manner, with the upper toggle. The reversing levers can preferably be moved when the switch latch moves such that the automatic reversal of the toggle system, inclusive of passing the throw-over point of the toggle during switching "off", is carried out by action of the reversing levers on the upper toggle. Further, when the contacts are welded together, on the way between the throw-over point and the "off" position, the switch latch preferably bears upon the selector shaft before the "off" position is reached.

In accordance with the present invention, the "off" throw-over point of the circuit breaker can preferably be controlled by means of the reversing levers in such a manner that the switch latch bears upon the selector shaft before reaching the "off" position, but after reaching the throw-over point if the contacts are welded together. As such, the circuit breaker with welded contacts essentially cannot be moved into the "off" position and therefore cannot be locked into the "off" position. If the circuit breaker in which the contacts are welded together were able to be locked into the "off" position, the position of the operating handle would give a dangerously incorrect indication of the state of the circuit. In other words, the position of the operating handle would indicate to an observer that the breaker is in the "off" position, when in reality the breaker is actually in the "on" position. By configuring a circuit breaker in accordance with the present invention, the safety requirements according to IEC 947 and EN 60947 can be complied with.

Further, the reversing levers can preferably be assembled in the path of the switch latch in such a manner that when the contacts are not welded together, the switch latch is moveable past the throw-over point to the "off" position, and the locking mechanism of the reversing levers can preferably be released without the switch latch coming to bear upon the selector shaft.

According to the present invention, the locking mechanism can preferably be triggered by arranging the reversing levers in the area between the switch latch and upper toggle so that it can be ensured that in essentially all cases the throw-over point of the toggle system of the circuit breaker is passed over when the switch latch is moved in the direction of the "off" position. Thereafter, according to the position of the moveable contact pieces, movement of the operating handle with the switch latch into the "off" position when the contact pieces are open is made possible, or alternatively, movement of the operating handle only as far as the stop on the selector shaft when the contact pieces are welded together is made possible, thereby preventing the operating handle from being locked into the "off" position.

The control of the throw-over point of the toggle system of the circuit breaker for operating the switch can preferably be carried out by the reversing lever, or the two reversing levers symmetrically mounted on the supporting lever. Preferably, the reversing levers are rotatably mounted on the supporting lever, for example by means of rivets, and the free ends thereof are in turn pivotable about a stationary axle. The free ends of the reversing levers can preferably project above the supporting lever and, in this area, can form a stop face. This stop face can preferably represent a bearing surface for cooperating with a corresponding counter-face of the switch latch, so that when the switch latch reaches a certain position, the counter-face of the switch latch preferably comes to bear upon the reversing levers.

The reversing levers can preferably be provided, on a side diametrically opposite to the stop face of the reversing lever, with a partial interlock for sliding along the upper toggle. In addition, the reversing lever can also be provided with an additional stop face, which additional stop face, when the switch latch reaches a certain position, additionally bears upon the upper toggle in order to limit the movement preferably of the upper toggle. The toggle system can preferably be connected at one end, by means of the contact carrier, to the moveable contact pieces and the selector shaft, and, at the other end, can be coupled to the supporting lever. Thus, the toggle system now preferably controls the position of the reversing lever by means of the supporting lever when the switch latch moves according to the position of the contact carrier and of the moveable contact pieces. As such, on the one hand, the throw-over point of the toggle system can essentially always be passed over when moving into the switched "off" position, and on the other hand, according to the position of the moveable contact pieces, either the locking mechanism is enabled by the bearing of the switch latch upon the selector shaft or reaching of the "off" position is made possible.

When the word "invention" is used in this specification, the word "invention" includes "inventions", that is, the plural of "invention". By stating "invention", the Applicants do not in any way admit that the present application does not include more than one patentably and non-obviously distinct invention, and maintains that this application may include more than one patentably and non-obviously distinct invention. The Applicants hereby assert that the disclosure of this application may include more than one invention, and, in the event that there is more than one invention, that these inventions may be patentable and non-obvious one with respect to the other.

One aspect of the invention resides broadly in a circuit breaker comprising: a housing; at least one electrical contact area disposed within the housing, the at least one electrical contact area having a stationary contact member; at least one breaker mechanism for connecting and disconnecting with the at least one electrical contact area, the at least one breaker mechanism being movably disposed within the housing; means for manually connecting and disconnecting the at least one breaker mechanism with the at least one electrical contact area; the means for manually connecting and disconnecting being pivotably displaceable between a first position and a second position; the at least one breaker mechanism comprising: contact carrier means pivotably disposed within the housing, the contact carrier means having a movable contact member for contacting the stationary contact member of the at least one electrical contact area to complete an electrical circuit; shaft means fixedly disposed on the contact carrier means; means for operatively connecting the means for manually connecting and disconnecting with the contact carrier means, the means for operatively connecting being configured for pivotally displacing the contact carrier means with respect to the at least one electrical contact area; the contact carrier means being pivotably displaceable between: a first, open position in which there is a substantial distance between the movable contact member and the stationary contact member; and a second, engaged position in which the movable contact member is in substantial, electrically conducting, contact with the stationary contact member; the means for operatively connecting comprising: means for moving the contact carrier means from the first, open position to the second, engaged position in response to movement of the means for manually connecting and disconnecting from the first position to the second position; and means for preventing movement of the means for manually connecting and disconnecting from the second position to the first position upon engagement of the movable contact member and the stationary contact member in the second, engaged position; the means for preventing movement comprising a stop portion configured for contacting on at least a portion of the shaft means to inhibit return movement of the means for manually connecting and disconnecting from the second position to the first position.

An additional aspect of the invention resides broadly in a method of operating a circuit breaker, the circuit breaker comprising: a housing; at least one electrical contact area disposed within the housing, the at least one electrical contact area having a stationary contact member; at least one breaker mechanism for connecting and disconnecting with the at least one electrical contact area, the at least one breaker mechanism being movably disposed within the housing; means for manually connecting and disconnecting the at least one breaker mechanism with the at least one electrical contact area; the means for manually connecting and disconnecting being pivotably displaceable between a first position and a second position; the at least one breaker mechanism comprising: contact carrier means pivotably disposed within the housing, the contact carrier means having a movable contact member for contacting the stationary contact member of the at least one electrical contact area to complete an electrical circuit; shaft means fixedly disposed on the contact carrier means; means for operatively connecting the means for manually connecting and disconnecting with the contact carrier means, the means for operatively connecting being configured for pivotally displacing the contact carrier means with respect to the at least one electrical contact area; the contact carrier means being pivotably displaceable between: a first, open position in which there is a substantial distance between the movable contact member and the stationary contact member; and a second, engaged position in which the movable contact member is in substantial, electrically conducting, contact with the stationary contact member; the means for operatively connecting comprising: means for moving the contact carrier means from the first, open position to the second, engaged position in response to movement of the means for manually connecting and disconnecting from the first position to the second position; and means for preventing movement of the means for manually connecting and disconnecting from the second position to the first position upon engagement of the movable contact member and the stationary contact member in the second, engaged position; the means for preventing movement comprising a stop portion configured for contacting on at least a portion of the shaft means to inhibit return movement of the means for manually connecting and disconnecting from the second position to the first position; the method comprising the steps of: providing a housing; providing at least one electrical contact area disposed within the housing; the step of providing the at least one electrical contact area comprises providing a stationary contact member; providing at least one breaker mechanism for connecting and disconnecting with the at least one electrical contact area, the at least one breaker mechanism being movably disposed within the housing; providing means for manually connecting and disconnecting the at least one breaker mechanism with the at least one electrical contact area, the means for manually connecting and disconnecting being pivotably displaceable between a first position and a second position; the step of providing the at least one breaker mechanism further comprises: providing contact carrier means pivotably disposed within the housing; the step of providing contact carrier means further comprises providing a movable contact member for contacting the stationary contact member of the at least one electrical contact area to complete an electrical circuit; providing shaft means fixedly disposed on the contact carrier means; providing means for operatively connecting the means for manually connecting and disconnecting with the contact carrier means, the means for operatively connecting being configured for pivotally displacing the contact carrier means with respect to the at least one electrical contact area; configuring the contact carrier means to be pivotably displaceable between: a first, open position in which there is a substantial distance between the movable contact member and the stationary contact member; and a second, engaged position in which the movable contact member is in substantial, electrically conducting, contact with the stationary contact member; the step of providing means for operatively connecting further comprises: providing means for moving the contact carrier means from the first, open position to the second, engaged position in response to movement of the means for manually connecting and disconnecting from the first position to the second position; and providing means for preventing movement of the means for manually connecting and disconnecting from the second position to the first position upon engagement of the movable contact member and the stationary contact member in the second, engaged position; the step of providing the means for preventing movement further comprises providing a stop portion configured for contacting on at least a portion of the shaft means to inhibit return movement of the means for manually connecting and disconnecting from the second position to the first position; the method further comprising the steps of: manually connecting the at least one breaker mechanism with the at least one electrical contact area by pivotally displacing the means for manually connecting and disconnecting from a first position to a second position; moving the contact carrier means, with the means for moving into the second, engaged position contacting the movable contact member with the stationary contact member to complete an electrical circuit; preventing movement of the means for manually connecting and disconnecting from the second position to the first position, with the means for preventing movement, upon engagement of the movable contact member and the stationary contact member; and contacting the at least a portion of the shaft means with the stop portion and inhibiting return movement of the means for manually connecting and disconnecting from the second position to the first position.

BRIEF DESCRIPTION OF THE DRAWINGS

The present invention will hereafter be explained by means of the schematic course of operations of the individual switch positions, and with reference to the accompanying drawings, in which.

DESCRIPTION OF THE PREFERRED EMBODIMENT

Figure 1:
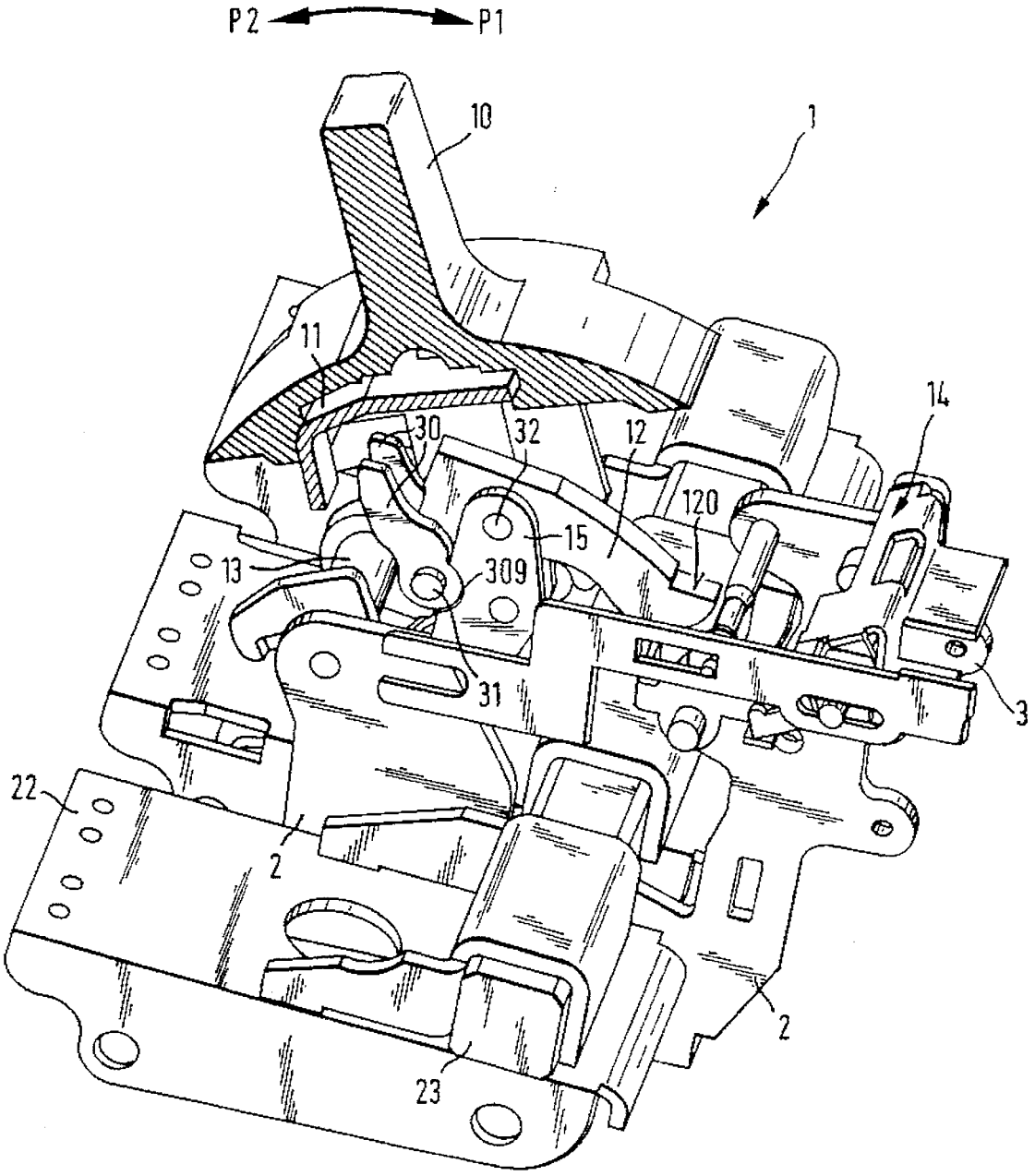
FIG. 1 shows a schematic perspective view of a circuit breaker in a partly opened state, without a housing.

The circuit breaker 1 shown in partial elevation in perspective in FIG. 1 can preferably be used in a compact switch which normally has a housing with a top and bottom part, which housing is not shown in FIG. 1 for purposes of simplicity. The circuit breaker 1 can preferably be mounted between two breaker plates 2,3, which breaker plates 2,3 can preferably be fixed place in the bottom part of the housing. The operating handle 10 can project out of an opening in the top part of the housing. The operating handle 10 can be used for the manual switching of contacts 24, 25 (see FIGS. 8 and 8*a*) into "on" and "off" positions, or "closed" and "open" positions, respectively. FIG. 1 shows the "on" or "closed" position of the breaker 1, i.e. the "rest" position of the breaker 1. The "on" and "off" switching movement is represented by means of the arrows P2 and P1, respectively.

Figure 3:
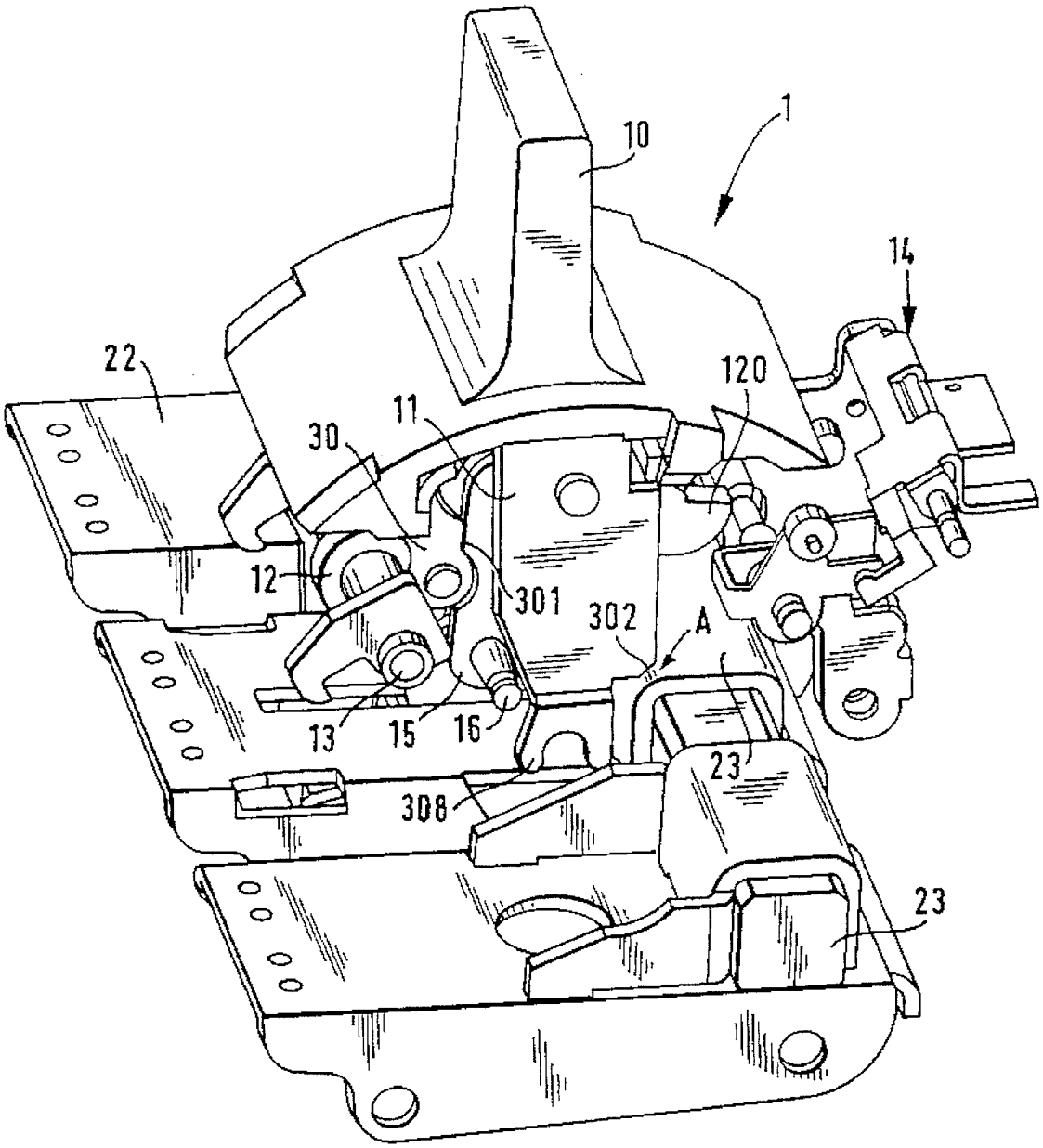
FIG. 3 shows a schematic perspective view of a circuit breaker according to FIGS. 1 and 2 in the locked state.
Figure 5:
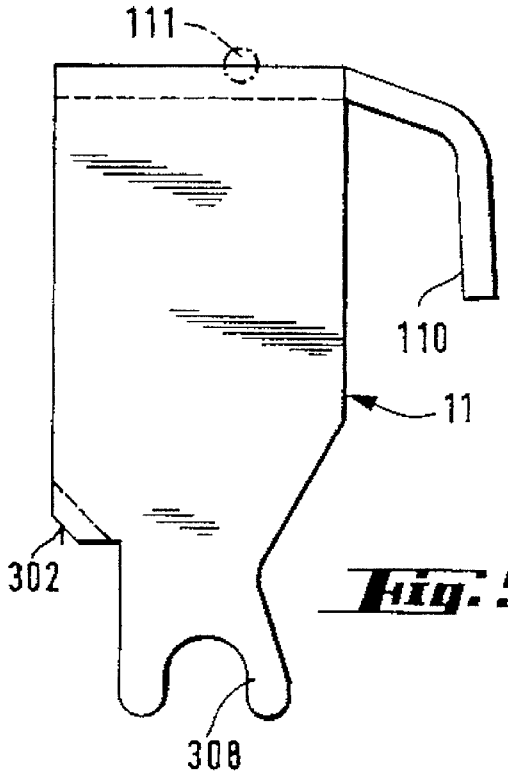
FIG. 5 shows an enlarged plan view of the switch latch.
Figure 5A:
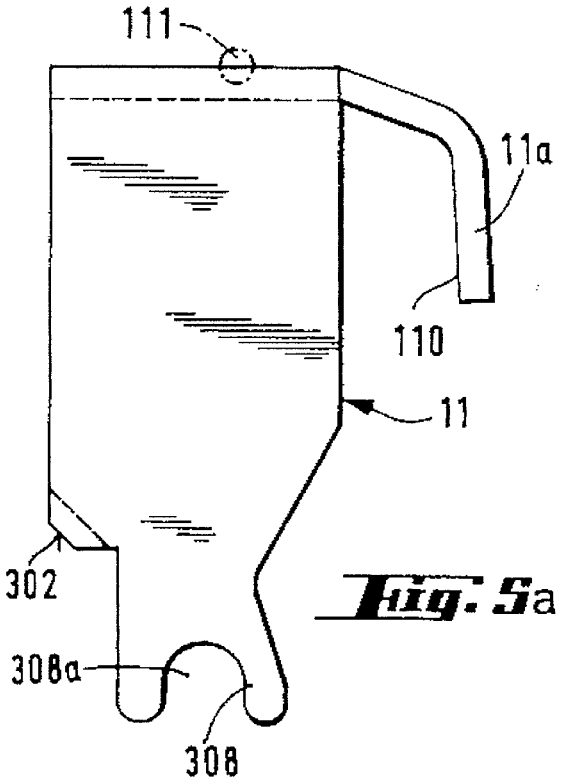
FIG. 5*a* shows substantially the same view as FIG. 5, but shows additional details.

The breaker 1 can additionally include a switch latch 11, which switch latch 11 can generally have a U-shape (see also FIGS. 3 and 5). This switch latch 11 can preferably be firmly fixed to the operating handle 10. Thus, the switch latch 11 can serve to transmit the movement of the operating handle 10 to the rest of the components of the breaker 1. The switch latch 11 can preferably be pivotably mounted in the breaker plates 2,3, wherein the switch latch 11 is guided by free arm ends 308. The free arm ends 308 can preferably be embodied by a semi-circular recess 308*a* (see FIG. 5*a*), which recess 308*a* can fit around a corresponding journal 2*a* (see FIG. 8*a*) of the breaker plates 2,3 (see also the view of the switch latch 11 shown in FIG. 5). In accordance with one preferred embodiment of the present invention, journal 2*a* can preferably be a stationary journal and can preferably extend between breaker plates 2,3. In accordance with one preferred embodiment of the present invention shown in FIG. 5*a*, the switch latch 11 can preferably have a projecting portion 11*a* which generally extends downward, i.e. towards journal 2*a*.

Figure 2:
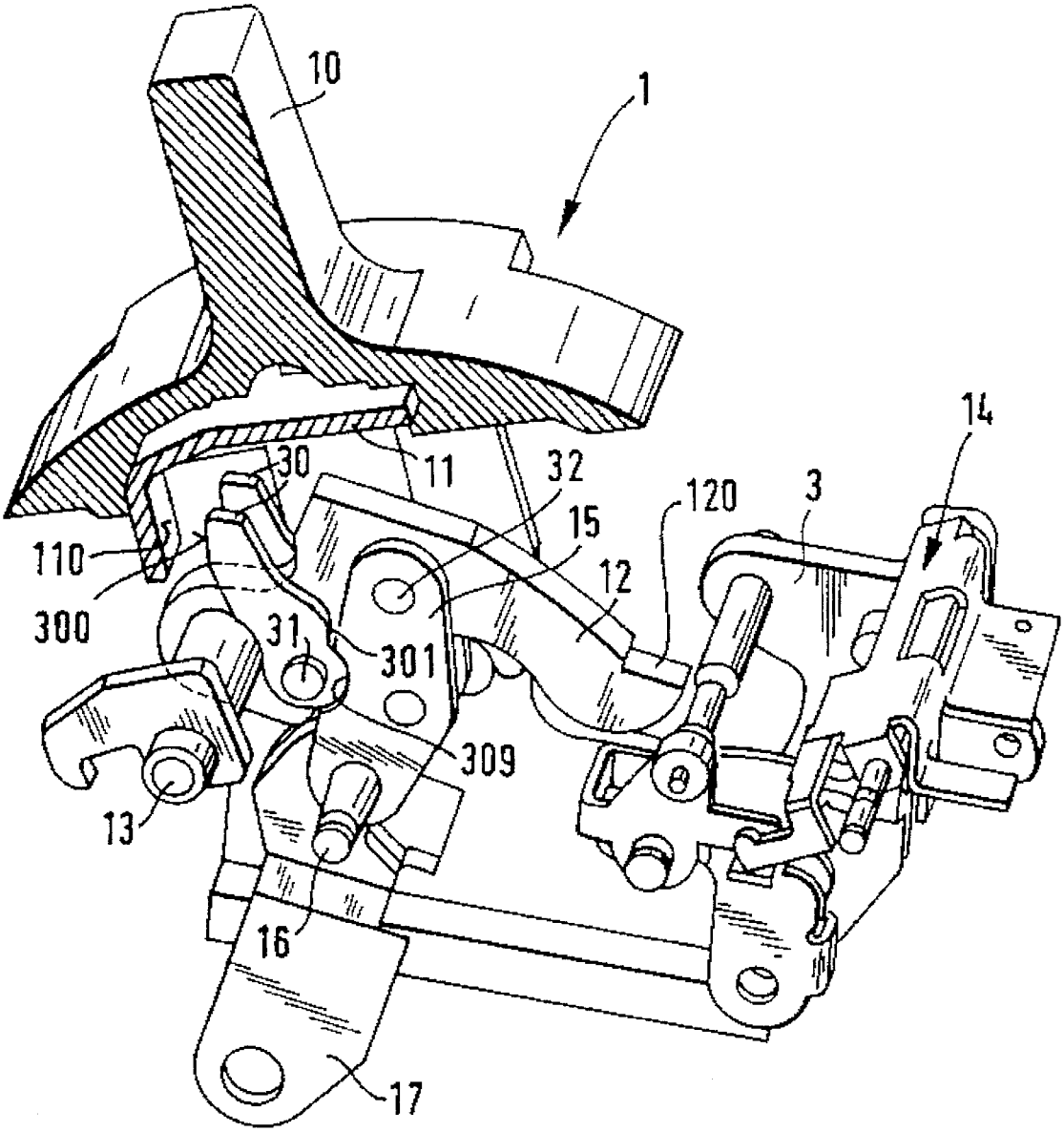
FIG. 2 shows a detail in perspective of the circuit breaker according to FIG. 1.
Figure 7:
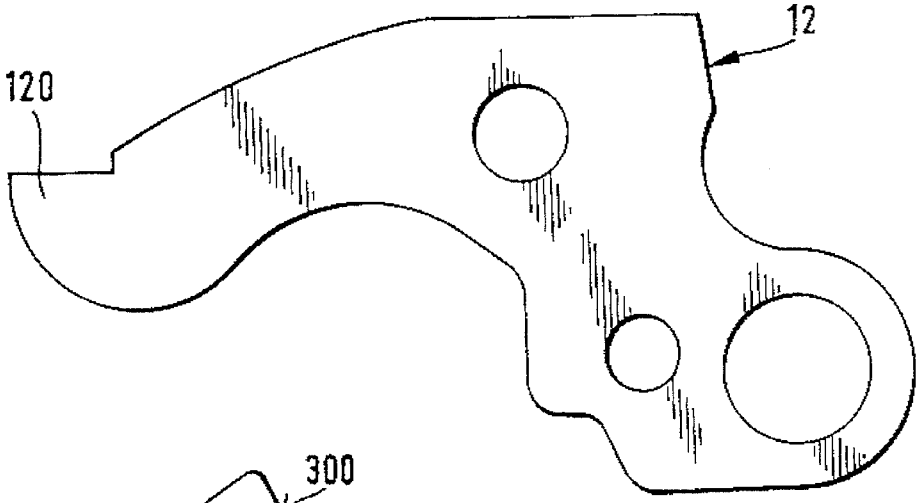
FIG. 7 shows an enlarged plan view of the supporting lever.
Figure 7A:
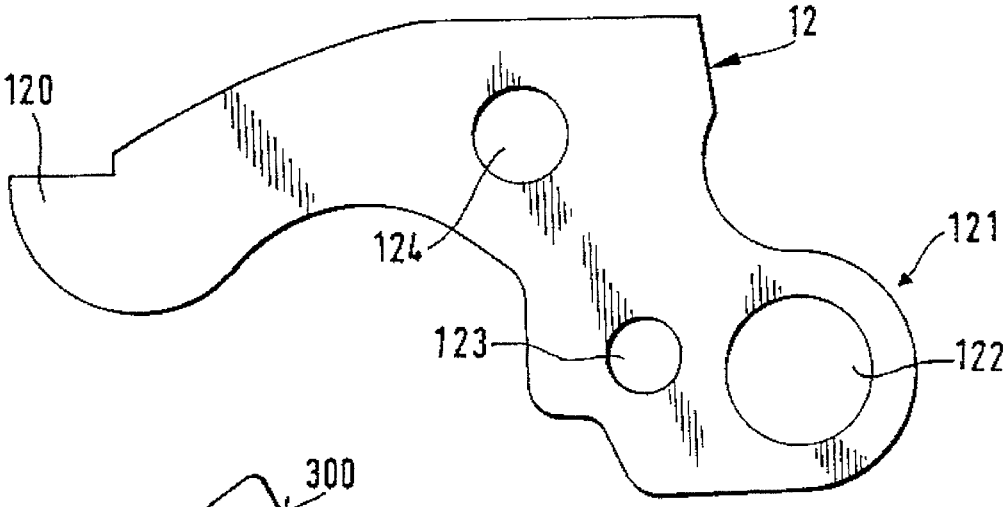
FIG. 7*a* shows substantially the same view as FIG. 7, but shows additional details.

A supporting lever 12, as shown in FIGS. 1, 2 and 3, is preferably pivotably mounted about a further stationary axle 13, which axle 13 extends parallel to a selector shaft 23. A plan view of the supporting lever 12 is shown in FIGS. 7 and 7*a*. The supporting lever 12 can preferably be overlapped by the switch latch 11. In accordance with one preferred embodiment of the present invention, the selector shaft 23 can preferably provide a rigid link between the contact carrier 22 and similar contact carriers located in each of the poles of the switch, which additional poles are not shown here for purposes of simplicity. A free end 120 of the supporting lever 12, i.e. the end opposite a mounting arrangement 121 (see FIG. 7*a*), preferably engages with a latch lever 14*a* (see FIG. 8*a*) on a latch 14 which is not described in more detail herein as such latches are well known. The latch 14 is in turn preferably operable by means of a thermal and/or magnetic trigger. Such thermal and magnetic triggers are also well known and will not be discussed further herein.

In accordance with one embodiment of the present invention shown in FIG. 7*a*, the mounting arrangement 121 of supporting lever 12 can preferably include a hole 122, through which hole 122 stationary axle 13 can be disposed. Thus, supporting lever 12 can preferably pivot about axle 13.

Figure 6:
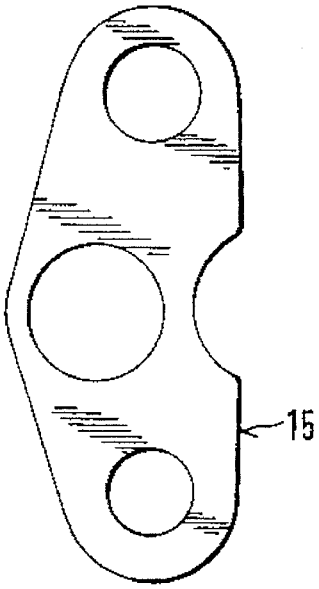
FIG. 6 shows an enlarged plan view of the upper toggle.
Figure 6A:
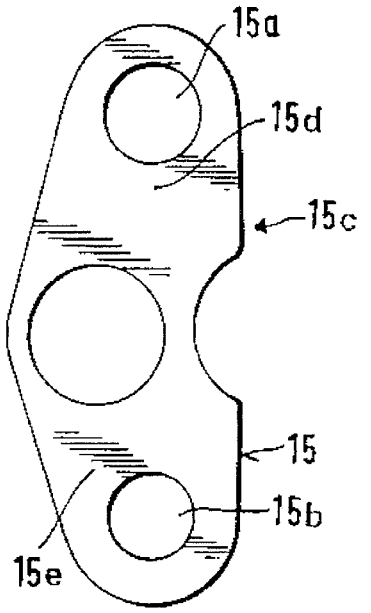
FIG. 6*a* shows substantially the same view as FIG. 6, but shows additional details.

A toggle system, which toggle system can best be seen in FIG. 2, can preferably include an upper toggle 15 and a lower toggle 17. A plan view of the upper toggle 15 is shown in FIGS. 6 and 6*a*. The toggle system can preferably be joined with the supporting lever 12, wherein both toggles 15, 17 can be movably connected to one another by means of a toggle axle 16. In accordance with one preferred embodiment of the present invention, toggle axle 16 is preferably not a stationary axle and can, as will be discussed later, pivot about stationary axle 2*a*. The toggle axle 16 can preferably extend through a lower hole 15*b* (see FIG. 6*a*) of upper toggle 15. Further, upper toggle 15 can preferably have an upper portion 15*d* and a lower portion 15*e* which can preferably be disposed at an angle with respect to one another. The upper toggle 15 can preferably be rotatably mounted, for example by means of a hole 15*a* (see FIG. 6*a*) and a hinge pin 32, on the supporting lever 12. The supporting lever 12 can preferably have a hole 124 (see FIG. 7*a*) in which the hinge pin 32 can be disposed. The lower toggle 17 can preferably be rotatably connected by means of a hinge pin 21 (see FIG. 8) to the contact carrier 22, and can thus pivot with respect to contact carrier 22. The contact carrier 22 preferably carries the moveable contact or contacts 24. The selector shaft 23 can additionally be firmly fixed to the contact carrier 22, wherein the contact carrier 22, together with the selector shaft 23, is pivotable about an axle 28. The axle 28 is preferably mounted in a stationary manner in the housing, for example to plates 2, 3. The toggles 15, 17 can preferably be acted upon by an actuating spring 19, which actuating spring 19 can be suspended between the upper end of the switch latch 11 from a suspension point 111 (see FIG. 5), and the toggle axle 16 (see also FIG. 8 wherein the spring 19 is shown schematically).

Figure 8:
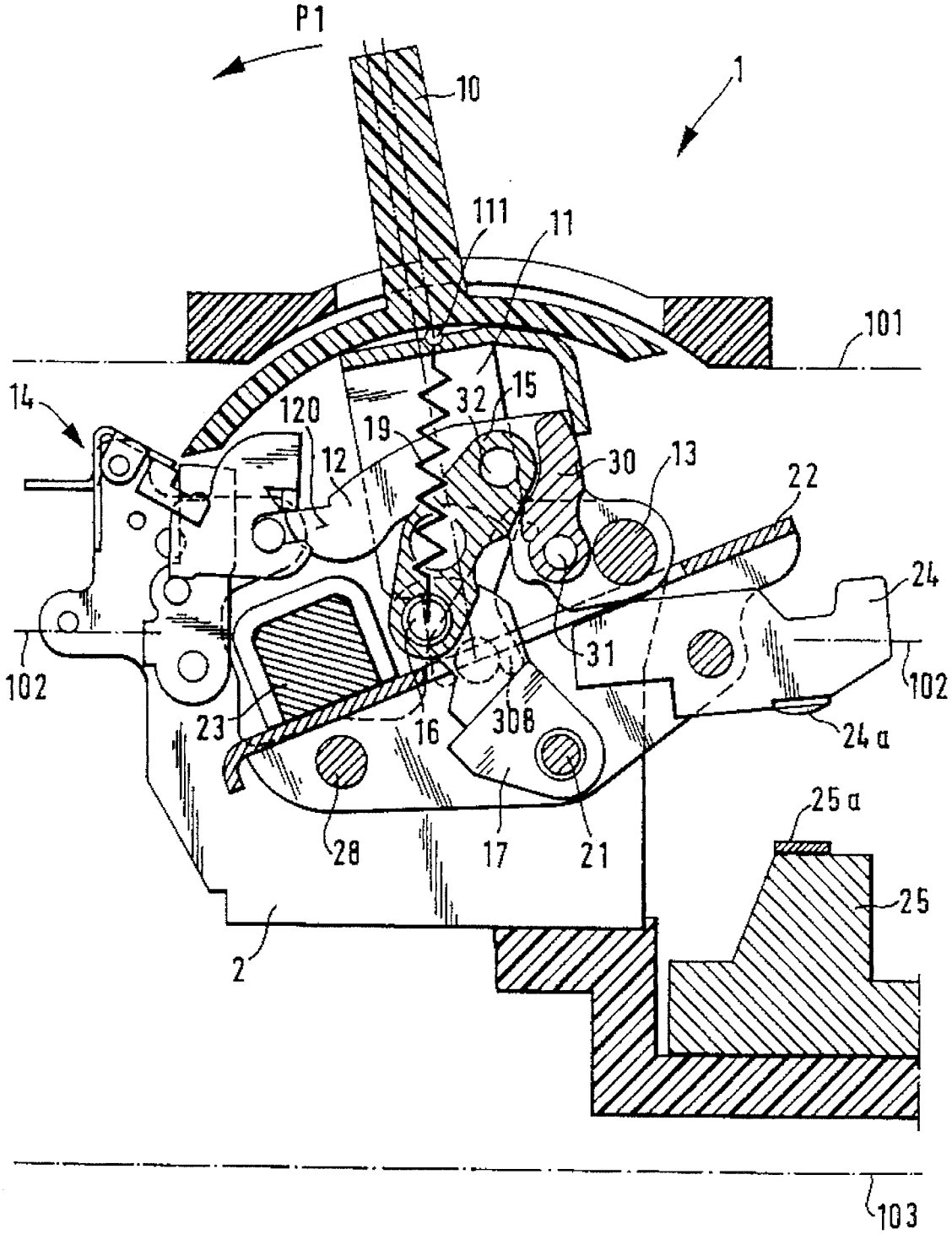
FIGS. 8–15 show schematic longitudinal views of the circuit breaker in the various operating positions of the "on" and "off" movement with the locking mechanism.

FIG. 8 shows schematically the longitudinal section through the circuit breaker 1 according to FIG. 1, and shows the breaker 1 in the "off" position. In addition, a top edge 101, a bottom edge 103, and a joint area 102 between upper and lower parts of the housing of the breaker 1 are shown in FIGS. 8–15. The top edge 101, the bottom edge 103 and the joint 102 are shown in dotted lines. It should be noted that the view shown in FIG. 8 is reversed or rotated by 180° with respect to the views shown in FIGS. 1–3. The contact parts 24,25 not shown in FIGS. 1–3 are schematically shown in FIG. 8. The selector shaft 23 can preferably mounted on contact carrier 22, and can thus rotate with contact carrier 22 about the axle 28 in the bottom part of the housing. The contact carrier 22 with the contact piece 24, which contact piece 24 can preferably be moveable by means of contact springs not shown here but which are well known, can be fixed together with a contact facing 24*a*, onto the selector shaft 23. The moveable contact piece 24 is opposite to the stationary contact piece 25, which contact piece 25 is preferably fixed in the bottom part of the housing. The contact piece 25 can also be provided with a contact facing 25*a*. When the operating handle 10 is moved in the direction of the arrow P1, over the throw-over point, into the switched "off" or "open" position, the toggles 15, 17 are preferably disposed inwardly, or towards selector shaft 23.

Figure 4:
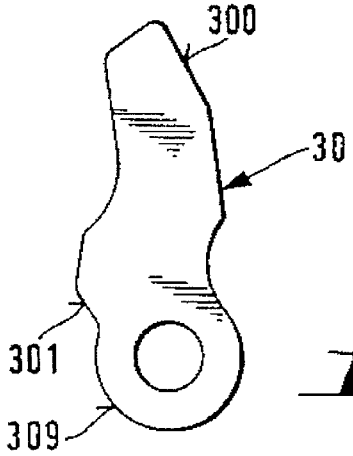
FIG. 4 shows an enlarged plan view of the reversing lever.
Figure 4A:
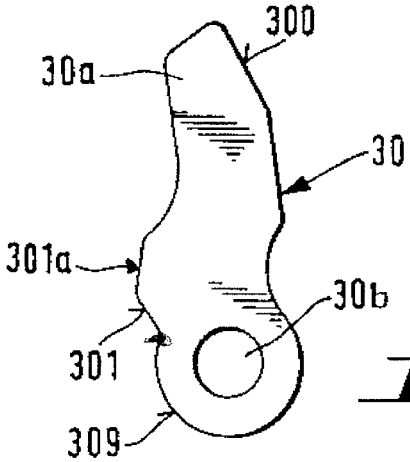
FIG. 4*a* shows substantially the same view as FIG. 4, but shows additional details.

Under some operating conditions, for example when the circuit breaker 1 is extremely overloaded or shorted, it can become possible that the contact faces 24*a*, 25*a* of the moveable contact piece 24 and of the stationary contact piece 25 could weld together more or less solidly. This welding of the contact faces 24*a*, 25*a* would essentially lead to locking of the moveable contact piece 24 in the "on" position. In the event of this welding together of the contact faces 24*a*, 25*a*, the circuit breaker 1 can preferably be provided with a device which prevents the operating handle 10 from moving in the direction of the arrow P1 into the switched "off" position and being locked therein, despite the welded condition of the moveable contact piece 24. This blocking of the movement of the operating handle 10 can preferably be achieved by means of a reversing lever or levers 30. A plan view of reversing lever 30 is shown in FIGS. 4 and 4*a*. The reversing lever 30 sits, as can be seen in FIGS. 1, 2, 3 and 8, on the supporting lever 12, and can preferably be fixed onto the supporting lever 12 in a rotatable manner by means of a rivet 31. In accordance with one preferred embodiment, supporting lever 12 can preferably have a hole 123 (see FIG. 7*a*), and the reversing lever 30 can preferably have a hole 30*b* (see FIG. 4*a*), in which holes 123 and 30*b* rivet 31 can be disposed. For reasons of symmetry, a reversing lever 30 can preferably be fixed on both sides of the supporting lever 12 as can best be seen in FIG. 1. The reversing lever 30 can thus be arranged between the upper toggle 15 and the supporting lever 12, which supporting lever 12 can be fixed to the stationary axle 13, in such a way that in an area 309 (see FIGS. 1 and 2), the reversing lever 30 preferably interlocks with the upper toggle 15. The reversing lever 30 can furthermore be configured to have a stop face 301 preferably in the form of a projection, which stop face 301 can bear upon the upper toggle 15 in an area 15*c* (see FIG. 6*a*) when the upper toggle 15 is in a certain position. The stop face 301, by means of the upper toggle 15, can thus exert a corresponding carrying or blocking movement for the reversing lever 30. In accordance with a preferred embodiment shown in FIG. 4*a*, stop face 301 can preferably have an essentially flat portion 301*a*.

The free ends 30*a* (see FIG. 4*a*) of the reversing levers 30 can preferably project above the supporting lever 12. These free ends 30*a* (see FIG. 4*a*) can preferably be provided on their sides opposite the upper toggle 15, i.e. on the sides opposite the stop face 301 of the reversing lever 30, with a further stop face 300 (see FIGS. 4 and 4*a*). The stop face 300 can preferably be in active contact with a corresponding counter-face 110 (see FIGS. 5*a* and 8*a*) of the portion 11*a* of switch latch 11 when there is an appropriate position or movement of the switch latch 11. The reversing levers 30 can now influence the movement of the switch latch 11 and thus also influence the operating handle 10 in connection with the current position of the contact carrier 22 of the selector shaft 23 and the moveable contacts 24. The reversing levers 30 preferably influence the path of the switch latch 11 into the "off" position such that when the contact faces 24*a*, 25*a* are welded together, the switch latch 11 essentially can no longer reach the "off" position, thus, the circuit breaker 1 cannot be switched into the "off" position. In the situation wherein the contact faces 24*a*, 25*a* are welded together, during movement of the operating handle 10 in the direction of arrow P1, the switch latch 11 preferably bears upon the selector shaft 23 before the "off" position can be reached, as indicated by stop A shown in FIGS. 3 and 15. Thus, the switch latch 11 can preferably be configured with a corresponding stop projection 302, see also FIGS. 5 and 5*a*, for this stopping action.

In view of the above, the arrangement of the toggle system 15,16,17, and reversing levers 30, and movement of each of the contact carrier 22, selector shaft 23 and switch latch 11, are preferably coordinated with one another so that the throw-over position of the toggle system 15,16,17 can essentially always be reached when the operating handle 10 is moved in the direction P1. Further movement in the direction P1 is then dictated by the position of the contacts 24, 25, so that when the contacts 24, 25 are not welded together, the "off" position can be reached, and so that when the contacts 24, 25 are welded together, the "off" position cannot be reached.

FIGS. 8–15 show schematically the individual operating positions of the circuit breaker 1 with the mechanism for blocking by means of reversing levers 30. The three parts substantially coming into active contact with each other, namely the switch latch 11, the upper toggle 15, and the reversing lever 30, are shown with cross-hatching. The representation and drawing is otherwise essentially schematic.

Figure 8A:
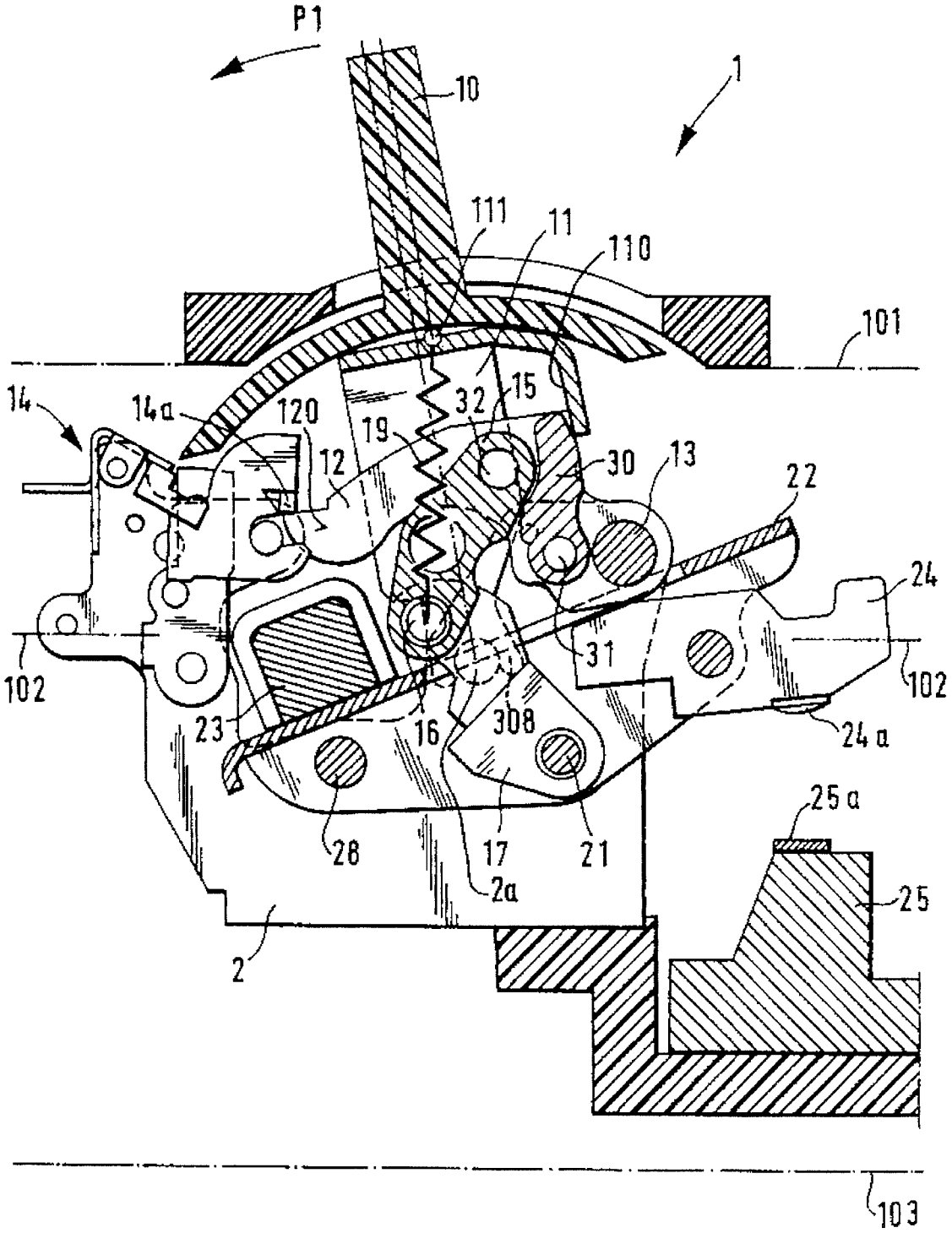

FIGS. 8 and 8*a* show the normal "off" position of the circuit breaker 1 when the contacts 24,25 are open. The actuating spring 19 between the switch latch 11 and toggle system 15,16,17 is shown schematically.

To get to the "off" position, according to FIGS. 8 and 8*a*, the throw-over point is passed over during movement of the operating handle 10 in the direction of the arrow P1 when the contacts 24, 25 are open. When the operating handle 10 is moved to the "off" position the system is in a tensioned state. It should be noted that the throw-over point can preferably be considered to be located at about the half-way point between the far left position of the handle 10 and the far right position of the handle 10. In the opened "off" position of the contacts 24,25, there can preferably be sufficient movement space for the reversing levers 30 and the upper toggle 15 to be moved into the position shown in FIG. 9, wherein the movement of the switch latch 11 beforehand into the "off" position is not prevented.

In accordance with at least one method of operation of the circuit breaker 1, when the breaker 1 is in the normal "off" position as shown in FIGS. 8 and 8*a*, the toggles 15, 17 can preferably be disposed approximately in an "L" configuration, or substantially perpendicular to one another. The spring 19 can preferably bias the axle 16 upwards, or towards operating handle 10. Since upper toggle 15 is rotatably fixed to the supporting lever 12, and since lower toggle 17 is rotatably fixed to carrier 22, toggles 15, 17 will preferably form this "L" configuration. Further, the free end 120 of the supporting lever 12 can preferably be engaged with lever 14*a* of latch 14, this position of supporting lever 12 being shown in FIGS. 8, and 8*a*.

Figure 9:
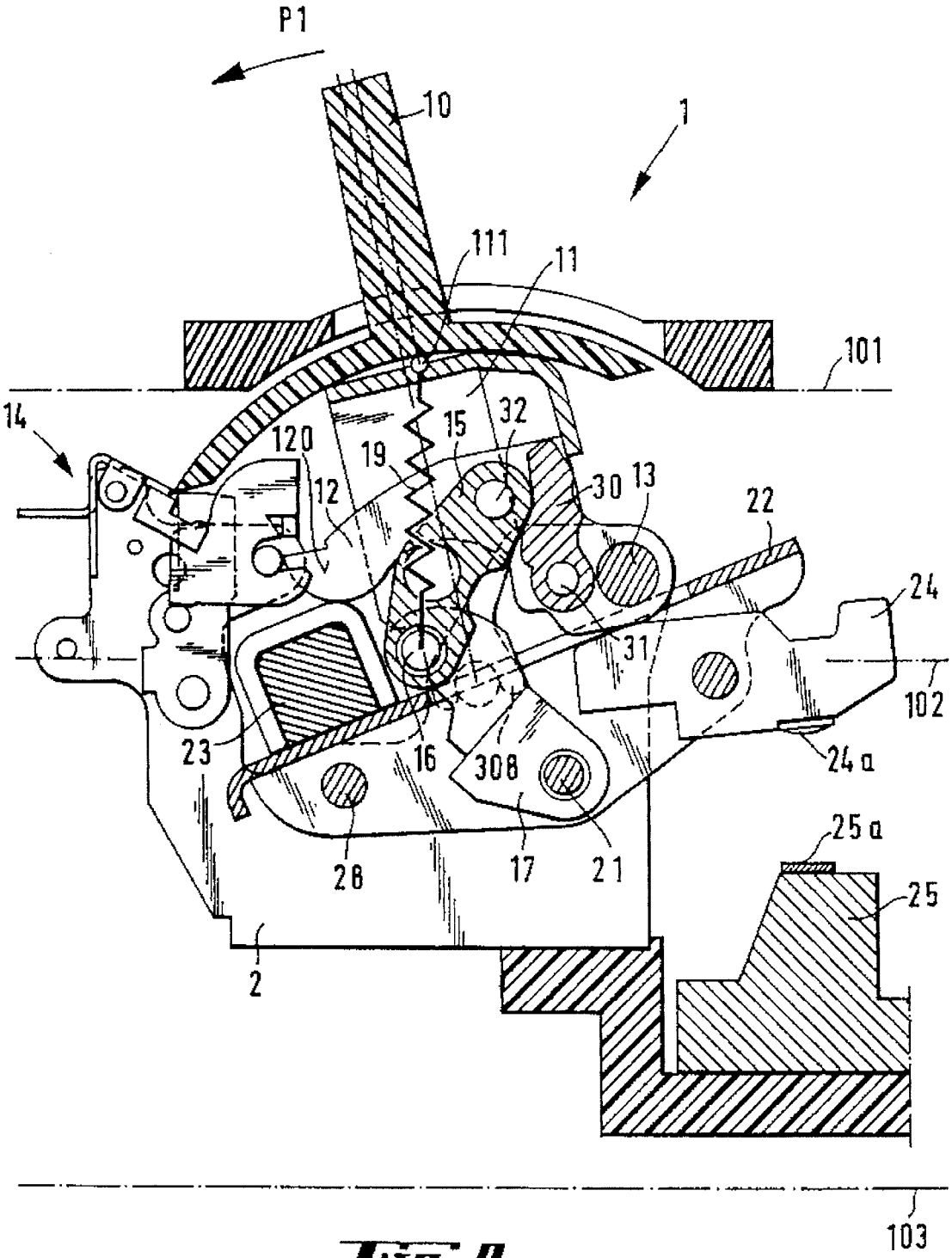
Figure 10:
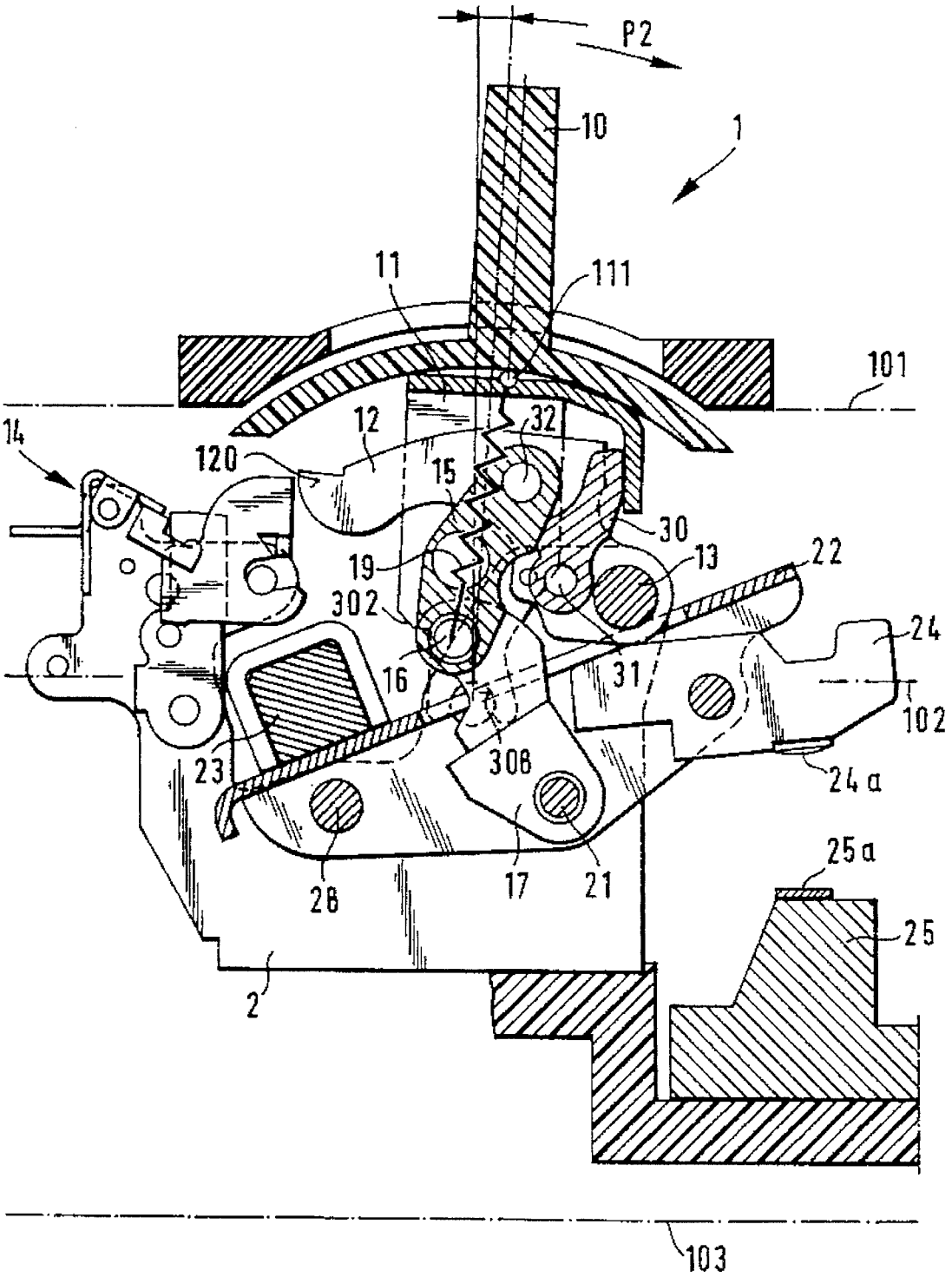
Figure 11:
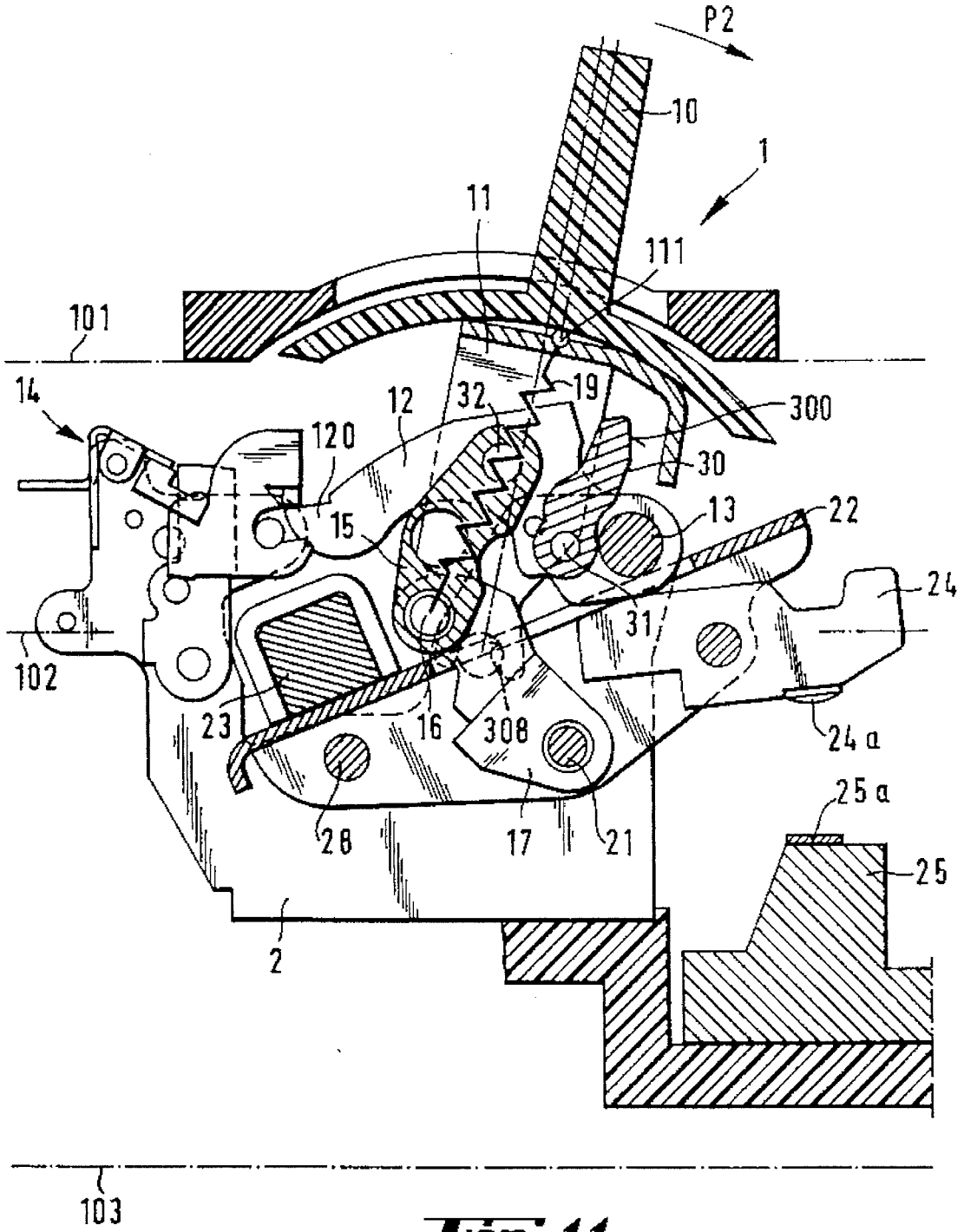

FIG. 10 shows the "triggered" or "tripped" position, i.e. the operating handle 10 and the switch latch 11 are moved from the "off" position in the direction of the arrow P2 into the closed position of the contacts 24, 25 following cocking of the circuit breaker 1 according to FIG. 9, wherein the throw-over point is passed over in the closing direction, see FIG. 11. The reversing lever 30 preferably does not prevent this movement.

In other words, and in accordance with one possible method of operation of the breaker 1, FIG. 10 can be considered to represent the condition of the breaker 1 when an overcurrent is sensed in the circuit by a mechanism essentially directly associated with latch 14, which mechanism can preferably cause latch 14 to release the end 120 of supporting lever 12. It should be noted that the "tripped" position of the breaker 1 shown in FIG. 10 can preferably be a subsequent position of the breaker 1 which can occur following a "closed" or "on" position of the breaker 1, such as that shown in FIG. 12. Thus, the supporting lever 12 can preferably pivot in a clockwise direction about axle 13, which pivoting movement of supporting lever 12 can preferably ultimately cause upper toggle 15 to pivot clockwise about axle 16, and cause lower toggle 17 to pivot counterclockwise about hinge 21, thus preferably releasing contact 24 from contact 25.

Figure 12:
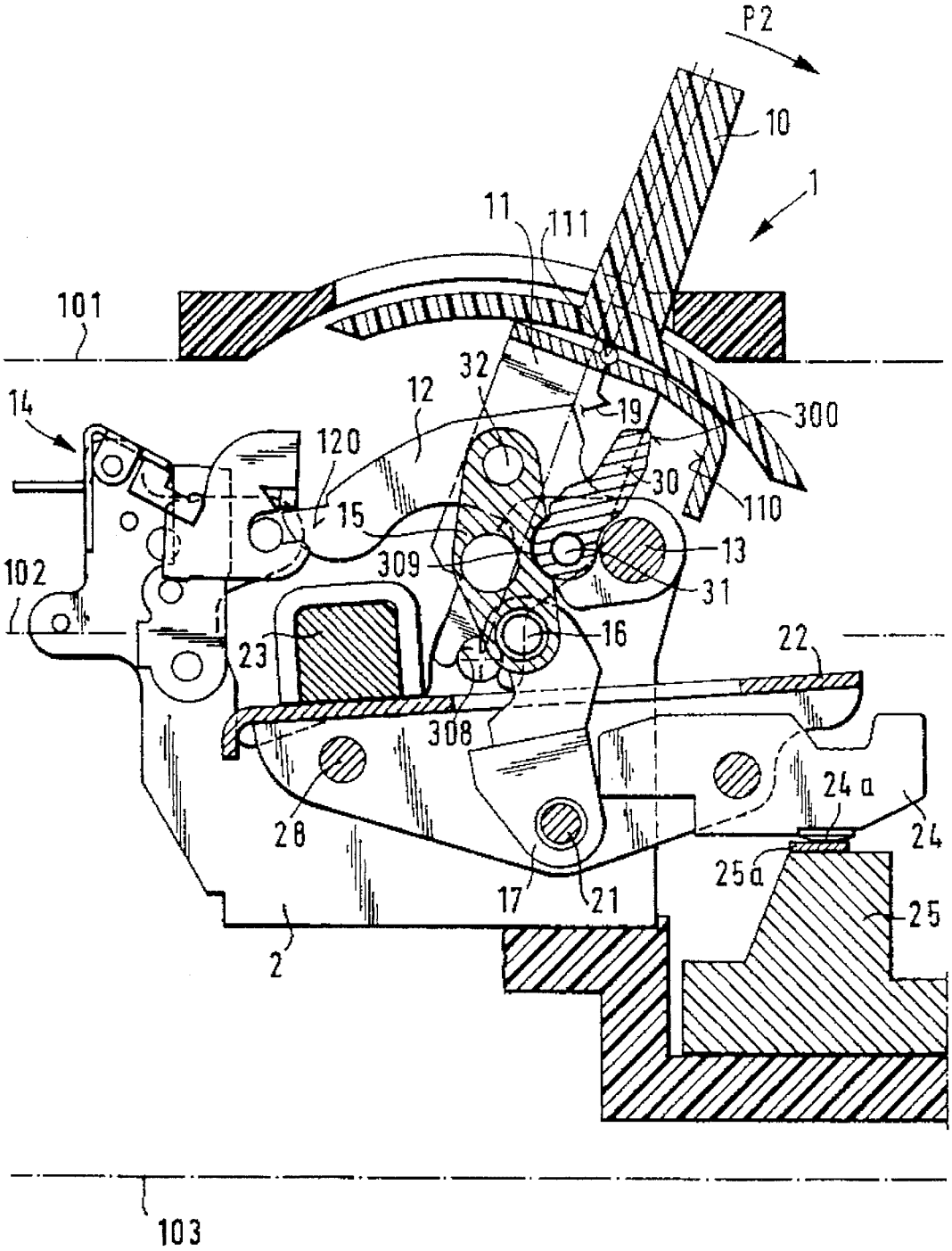

To continue, after the breaker 1 is "tripped", the breaker 1 will typically have to be "cocked" before resetting the breaker 1 into the "on" position. In order to "cock" the breaker 1, the handle 10 must then be moved by the operator in the direction P1 until the "off" position is reached. FIGS. 8, 8*a*, and 9 can be considered to represent this "cocking" movement. Further, it should be noted that FIG. 9 can be considered to represent the further positioning of the breaker 1 into the "off" or "open" position. Thus, the positions of the breaker 1 in FIGS. 11 and 12 can be considered to represent the motion of the breaker 1 into the "on" position during resetting of the breaker 1 after "tripping" has occurred. Referring specifically to FIG. 11, as the handle 10 is moved in the direction P2, the spring 19 can preferably pull upwards on axle 16 thereby pivoting axle 16 clockwise about hinge 21, and thus toggle 17 can preferably be pivoted about hinge 21 in the clockwise direction. Toggle 17 can then preferably cause carrier 22 to pivot to move contact 24 downwards, i.e. towards contact 25, until the position of the breaker 1 in FIG. 12 is reached. In accordance with this particular method of operating of the circuit breaker 1, the continued movement of the operating handle 10 in direction P2 can preferably cause spring 19 to pull axis 16 clockwise about hinge 21, until toggle 15 is pivoted about axis 16 counterclockwise and thus toggle 15 and reversing lever 30 can interlock with one another. Further, in accordance with one embodiment, spring 19 can preferably be a relatively strong spring.

In FIG. 12 the switching "on" movement P2 is essentially finished and the contact faces 24*a*, 25*a* are preferably touching one another, or closed. Further, the toggle 15 and reversing lever 30 are preferably in an interlocking position, as discussed immediately above.

Figure 13:
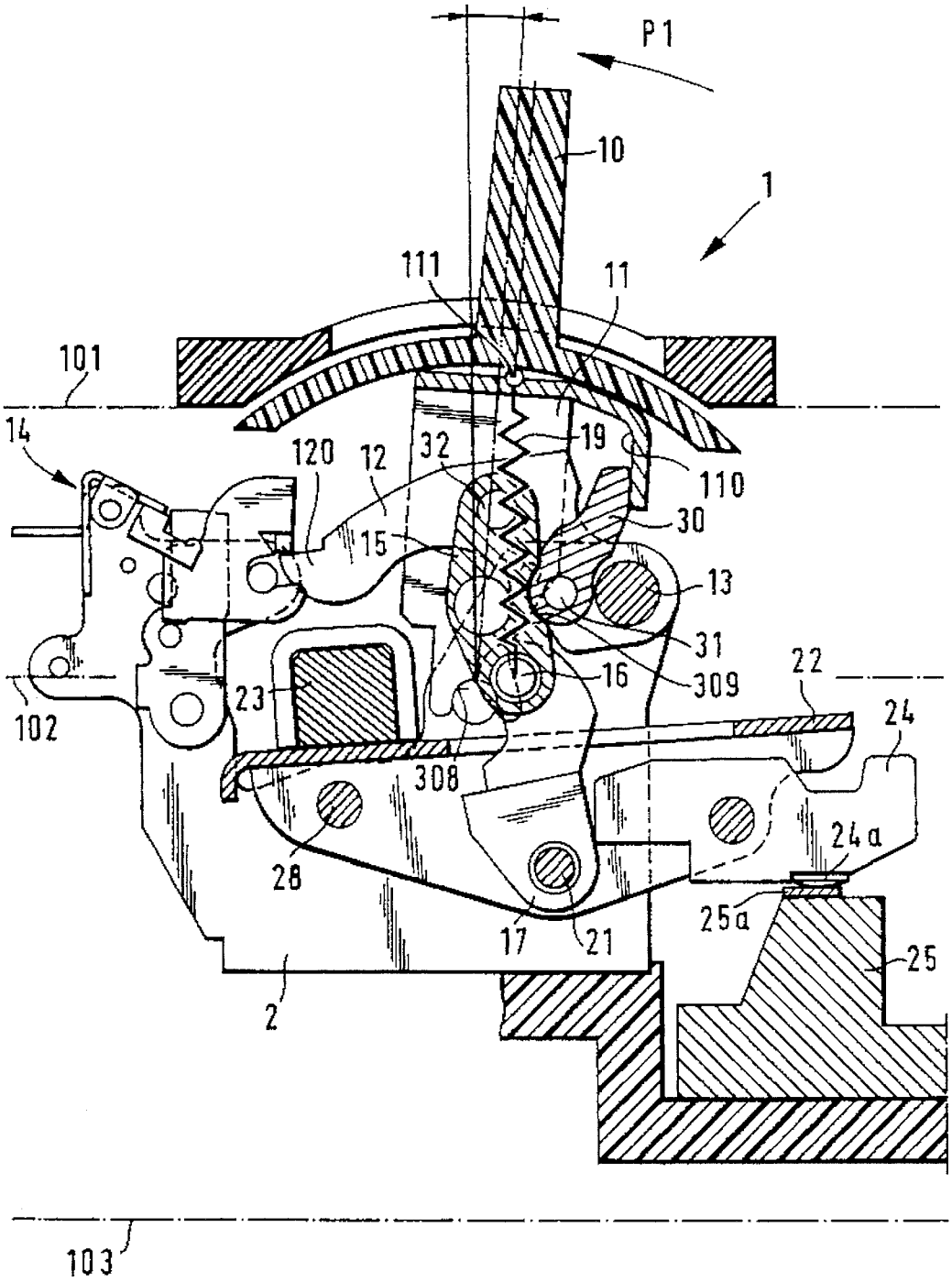
Figure 14:
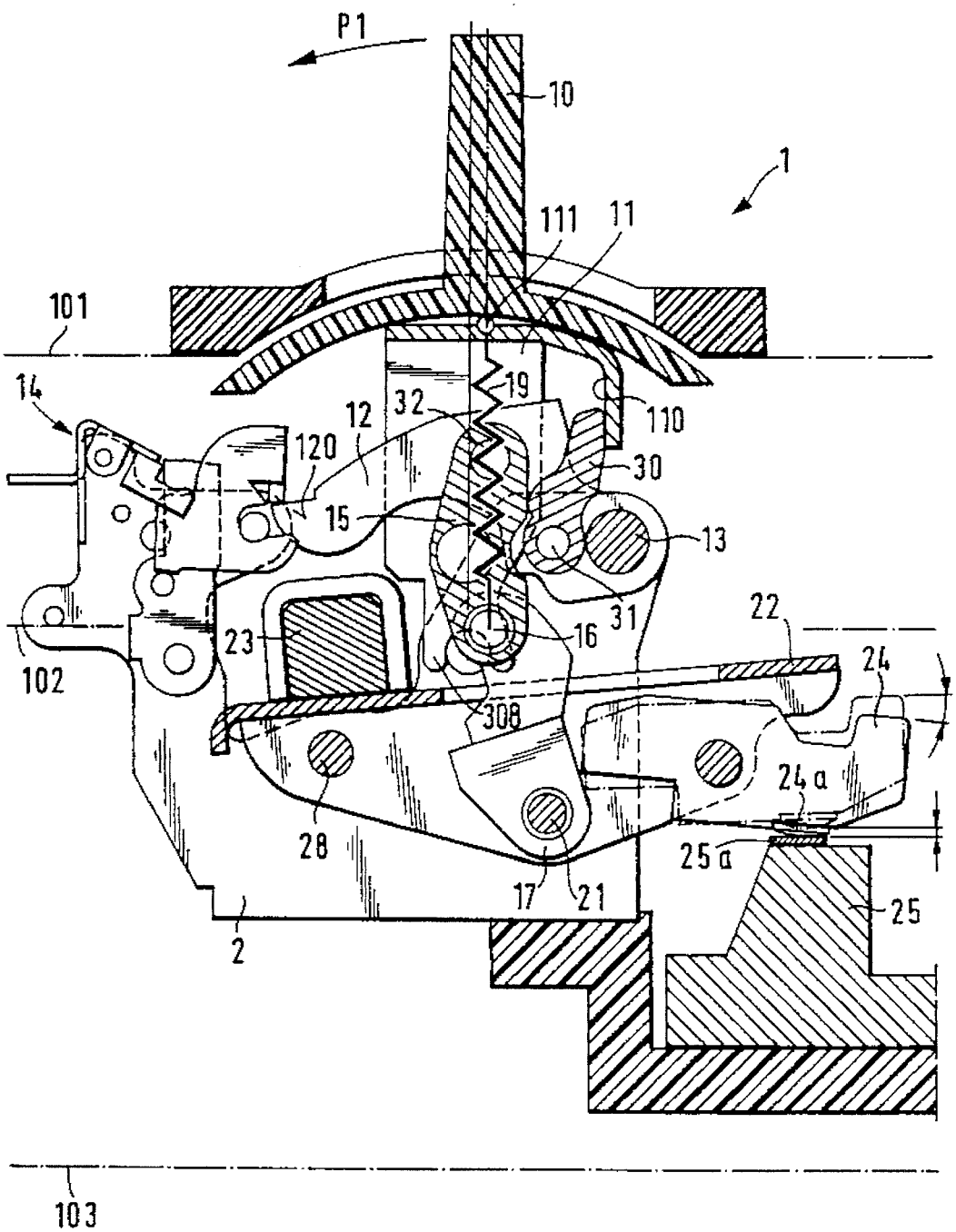

FIG. 13 shows the situation where during switching "off" and movement of the operating handle 10 in the direction P1 the contact faces 24*a*, 25*a* are welded together and the contact carrier 22 and thus the toggle system 15,16,17 are held fast in the lower position by means of the lower toggle 17. The movement of the operating handle 10 together with the switch latch 11 in the switching "off" direction, i.e. the direction of the arrow P1, can be partially carried out, that is, until the throw-over point according to FIG. 14 is passed, see FIG. 15, but the "off" position according to FIGS. 8 and 8*a* is still not reached. After passing the throw-over point shown in FIG. 14, preferably because of the bearing of the reversing lever 30 on the switch latch 11 and the corresponding position of the selector shaft 23 in the closed position of the contact faces 24*a*, 25*a*, when moving into the "off" position, the switch latch 11 preferably bears with its stop 302 upon the selector shaft 23 and thus blocks the further movement of the operating handle 10 into the "off" position. The precise control of the switch latch 11 in the stop position according to FIG. 15 can preferably be achieved by the interlocking caused by the corresponding position of the toggle 15 and reversing lever 30 and the effective stop face 301. According to FIG. 15, the operating handle 10 can now essentially no longer be moved into the "off" position after the switch latch 11 is brought to bear upon the selector shaft 23, so that the switching of the circuit breaker 1 into the "off" position, when the contacts 24, 25 are welded, is prevented. The arrangement and configuration of the reversing levers 30 preferably allows the triggering of the throw-over point of the toggle system 15, 16, 17 together with the actuating spring 19 when the switch latch is moved, such that the "off" position essentially cannot be reached after passing the throw-over point, if the contacts 24, 25 are welded.

Thus, in accordance with one sequence of operating positions of the breaker 1, the breaker 1 can initially be in the "closed" position shown in FIG. 12. After the breaker is tripped, the breaker 1 can be in the position shown in FIG.

10. The breaker 1 can then be "cocked" as shown in FIGS. 8, 8*a*, and 9, and can then be reset starting with the position shown in FIG. 11 and preferably ending with the "on" position shown in FIG. 12. Further, if the contacts 24, 25 are welded in the position shown in FIG. 13, movement of the operating handle 10 towards the "open" position can be limited as shown by the sequence of operating positions shown in FIGS. 14 and 15.

Figure 15:
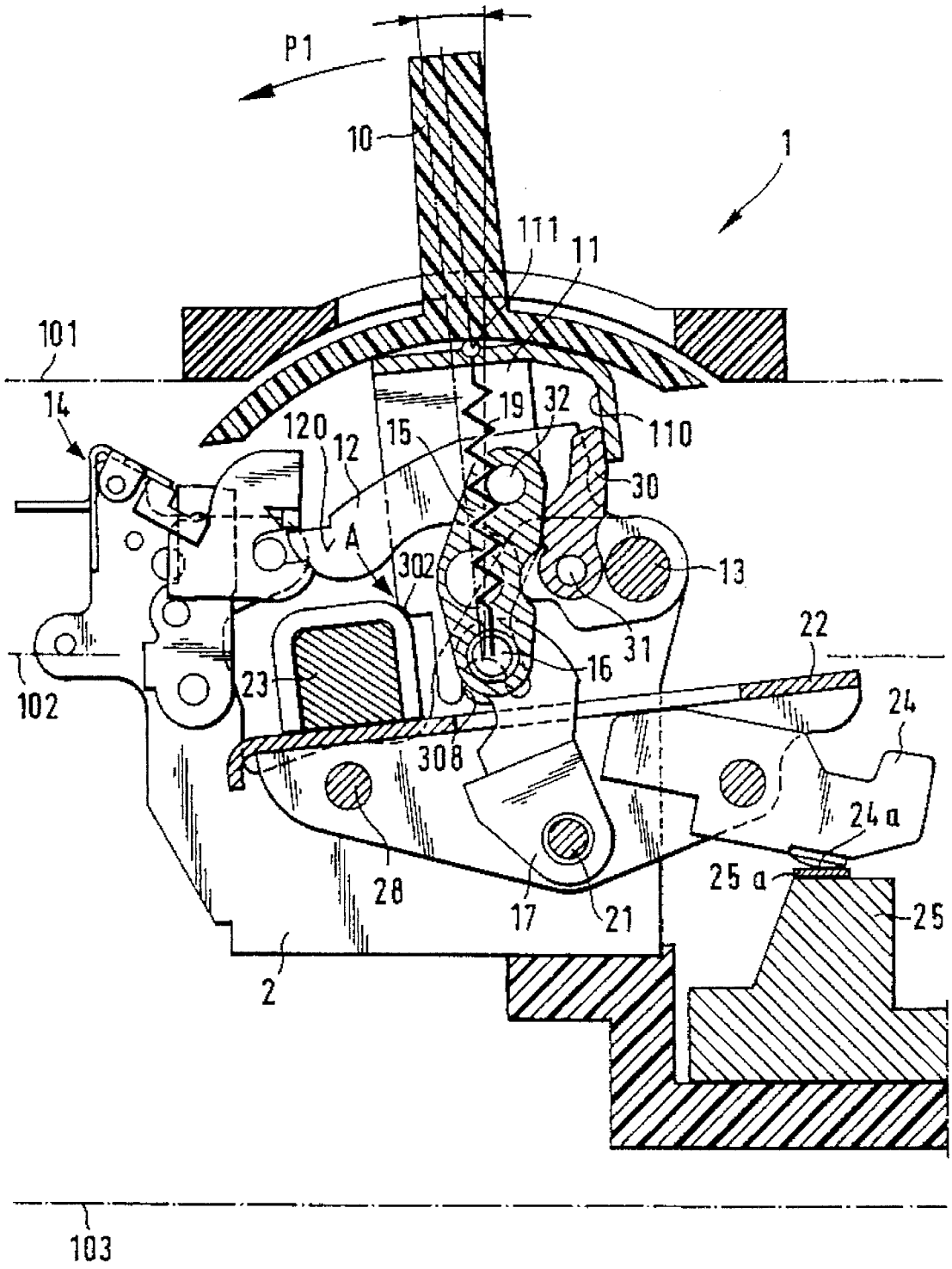

In accordance with one embodiment, reversing lever 30 can be considered as functioning to "reverse" the "L" position of the upper toggle 15 and the lower toggle 17 as described above and shown in FIGS. 8, 8*a*, and 9 in the "off" position of the breaker 1, in that reversing lever 30 can cause upper toggle 15 and lower toggle 17 to "straighten out" or "reverse" as shown in FIGS. 13–15.

In accordance with an alternative embodiment of the present invention not shown here, the breaker 1 of the present invention could conceivably be configured such that reversing lever 30 and toggle 15 would essentially be one unitary toggle piece preferably being connected in a pivotable manner to lower toggle 17. In accordance with this particular embodiment, the stopping action on the handle 10 when the contacts 24,25 are welded together would essentially be accomplished by the contact between projection 302 of switch latch 11 and selector shaft 23.

In accordance with yet an additional embodiment of the present invention not shown here, the positions of toggle 15, reversing lever 30, the lower toggle 17, and the end 120 of supporting lever 12 as shown in FIG. 15 could conceivably be adequate to stop the operating handle 10 from being moved into the "off" position when the contacts 24,25 are welded together. Thus, in accordance with this particular embodiment, the stopping action of projection 302 of switch latch 11 on selector shaft 23 could conceivably be unnecessary.

One feature of the invention resides broadly in the circuit breaker with a switch latch moveable by means of a manual operating handle for the purpose of switching on and off, a supporting lever which is moved along therewith, one end of which is pivotable about a fixed axle and the other end of which co-operates with a latch, and a toggle system with an upper and a lower toggle connected together in an articulated manner by means of a toggle axle, the upper toggle of which is coupled to the supporting lever and the lower toggle of which is coupled to a contact carrier provided with moveable contact members and connected to a selector shaft, and an actuating spring arranged between the switch latch and toggle axle acting upon the toggle system as well as a reversing lever preventing the transfer of the manual operating handle into the switched off position when the moveable contact members are blocked in the on position due to welding, characterized in that a reversing lever (30) is rotatably mounted on both sides of the supporting lever (12), and a part thereof is in contact in an interlocking manner with the upper toggle (15), and the reversing levers (30) are moved when the switch latch (11) moves such that the automatic reversal of the toggle system inclusive of passing the throw-over point of the toggle during switching off is carried out by action of the reversing levers (30) on the upper toggle (15) and when the contacts are welded, on the way between the throw-over point and the off position, the switch latch (11) bears upon the selector shaft (23) before the off-position is reached.

Another feature of the invention resides broadly in the circuit breaker characterized in that the off throw-over point of the toggle system is controllable by means of the reversing levers (30).

Yet another feature of the invention resides broadly in the circuit breaker characterized in that the reversing levers (30) are fixed rotatably on the supporting lever (12) by means of rivets (31) and are provided, on their free ends projecting over the supporting lever (12), with a stop face (300) for cooperating with a corresponding counter face (110) of the switch latch (11).

Still another feature of the invention resides broadly in the circuit breaker characterized in that the reversing levers (30) are provided with a stop face (301) on their sides adjacent to the upper toggle (15) for limiting movement by stopping the upper toggle (15).

A further feature of the invention resides broadly in the circuit breaker characterized in that the switch latch (11) is provided with a shaped stop face (302) which, when the contacts are welded, bears upon the selector shaft (23).

Examples of circuit breakers, and components found therein, which may be utilized in accordance with the embodiments of the present invention, may be found in the following U.S. Pat. Nos. 4,750,375 to Godesa, entitled "Drive Device for a Circuit Breaker with a Ratchet Wheel"; No. 4,678,873 to Preuss and Berndt, entitled "Low Voltage Circuit Breaker . . . "; No. 4,380,785 to Demayer and Claudin, entitled "Solid State Trip Unit . . . "; No. 4,695,913 to Terracol and Roulet, entitled "Shunt Effect Low Voltage Circuit Breaker"; No. 5,296,664 to Crookston et al., entitled "Circuit Breaker with Positive Off Protection"; and No. 5,369,384 to Heins, entitled "Power Circuit Breaker with a Breaker Mechanism and a Breaker Mechanism for a Power Circuit Breaker".

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. G 94 01 785.9, filed on Feb. 2, 1994, having inventors Hans-Jürgen Mader and Rainer Arenz, and DE-OS G 94 01 785.9 and DE-PS G 94 01 785.9, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. Circuit breaker comprising:

a switch latch and a manual operating handle, the switch latch being moveable by means of the manual operating handle, the manual operating handle being movable between an "on" position and an "off" position for the purpose of switching the circuit breaker on and off;

a supporting lever which is moved along with the switch latch, the supporting lever having a first end and a second end disposed a substantial distance from one another, and two sides facing away from one another;

the first end of the supporting lever being pivotable about a fixed axle and the second end of the supporting lever co-operating with a latch;

a contact carrier having a movable contact member;

a selector shaft connected to the contact carrier;

a stationary contact member disposed opposite the movable contact member;

a toggle system having an upper and a lower toggle connected to one another by means of a toggle axle;

the upper toggle and the lower toggle having a position both when the manual operating handle is in the "off" position and when the movable contact member and the stationary contact member are not welded to one another;

the upper toggle being coupled to the supporting lever and the lower toggle being coupled to the contact carrier;

an actuating spring arranged between the switch latch and the toggle axle for acting upon the toggle system;

reversing levers for preventing the movement of the manual operating handle into the "off" position when the moveable contact member is welded to the stationary contact member;

the reversing levers being rotatably mounted on both sides of the supporting lever, the reversing levers each having a part configured for contacting the upper toggle in an interlocking manner;

the reversing levers being configured for movement along with movement of the switch latch, such that, when the movable contact member is welded to the stationary contact member, the position of the toggle system is reversed substantially upon passing a throw-over point defined between the "off" position of the manual operating handle and the "on" position of the manual operating handle, during movement of the manual operating handle into the "off" position;

the reversing of the position of the toggle system being carried out by means of the reversing levers acting on the upper toggle; and during movement of the manual operating handle between the throw-over point and the "off" position of the manual operating handle when the movable contact member is welded to the stationary contact member, the switch latch bears upon the selector shaft before the "off" position of the manual operating handle is reached.

2. Circuit breaker according to claim 1, wherein the throw-over point is controllable by means of the reversing levers.

3. Circuit breaker according to claim 2, wherein:

the reversing levers each have a first end and a second end disposed a substantial distance from one another, the first ends of the reversing levers being fixed on the supporting lever by means of rivets such that the reversing levers are rotatable with respect to the supporting lever, and the second ends of the reversing levers projecting over the supporting lever; and the second ends of the reversing levers each having a stop face for cooperating with a corresponding counter face of the switch latch.

4. Circuit breaker according to claim 3, wherein:

the stop face of each of the reversing levers is a first stop face;

the reversing levers each have a first side and a second side facing away from one another, the first side of each reversing lever facing the upper toggle and the second side of each reversing lever comprising the first stop face;

the reversing levers each being provided with a second stop face on their first sides adjacent to the upper toggle, the second stop faces for limiting movement of the upper toggle.

5. Circuit breaker according to claim 4, wherein the switch latch is provided with a shaped stop face adjacent the selector shaft, which shaped stop face, when the movable contact member is welded to the stationary contact member, bears upon the selector shaft.

* * * * *